US011149438B2

(12) United States Patent
Torman et al.

(10) Patent No.: US 11,149,438 B2
(45) Date of Patent: Oct. 19, 2021

(54) LOUVERED PANEL ASSEMBLY

(71) Applicant: Sundance Louvered Roofs, LLC, Ogden, UT (US)

(72) Inventors: Hal Torman, Ogden, UT (US); Cass Brinkman, Merriam, KS (US)

(73) Assignee: Sundance Louvered Roofs LLC, Unitah, UT (US)

( * ) Notice: Subject to any disclaimer, the term of this patent is extended or adjusted under 35 U.S.C. 154(b) by 0 days.

(21) Appl. No.: 16/510,943

(22) Filed: Jul. 14, 2019

(65) Prior Publication Data

US 2019/0338528 A1 Nov. 7, 2019

Related U.S. Application Data

(63) Continuation-in-part of application No. 16/398,855, filed on Apr. 30, 2019, now abandoned.

(60) Provisional application No. 62/664,377, filed on Apr. 30, 2018.

(51) Int. Cl.
*E06B 7/08* (2006.01)
*E04F 10/10* (2006.01)

(52) U.S. Cl.
CPC ..... *E04F 10/10* (2013.01)

(58) Field of Classification Search
CPC ..... E04F 10/10; E04B 7/166; E04B 7/163
USPC ..... 49/91.1; 52/473
See application file for complete search history.

(56) References Cited

U.S. PATENT DOCUMENTS 4,038,781 A * 8/1977 Graham ..... E06B 7/084 49/91.1
4,527,355 A * 7/1985 Numakami ..... E04F 10/10 49/275
4,926,599 A * 5/1990 Scholz ..... E04F 10/10 49/87.1
5,306,210 A * 4/1994 Smit ..... F24F 7/02 454/250
5,358,024 A * 10/1994 Schwaegerle ..... E06B 9/386 160/236
5,394,925 A * 3/1995 Ives ..... E06B 9/386 160/236

(Continued)

FOREIGN PATENT DOCUMENTS

CA 2971702 A1 * 6/2016 ..... E04F 10/08
FR 3042802 A1 * 4/2017 ..... E03B 3/03
WO WO-2015063699 A1 * 5/2015 ..... E04F 10/08

*Primary Examiner* — Jerry E Redman
(74) *Attorney, Agent, or Firm* — Ingram IP Law, P.A.

(57) ABSTRACT

The technology provides an improved louvered panel assembly having a louver panel with at least a first louver and a second louver and a pivot bar that extends therebetween. A control arm is secured between the pivot bar and an operator to rotate the louver panel between open and closed positions. The first and second louvers include a central receiver that receives a first bearing surface to rotate the louvers about a rotational axis extending therethrough. A leading projection extends from the first louver and is rotated downward as the first louver operates between open and a closed positions. A trailing projection extends from the second louver and is rotated upward as the second louver operates between open and a closed positions. An elongated track is positioned below the louver panel and is spaced from the louver panel by a flap structure having a sealing membrane.

18 Claims, 8 Drawing Sheets

(56) References Cited

U.S. PATENT DOCUMENTS

| | | | | |
|---|---|---|---|---|
| 5,732,507 | A * | 3/1998 | Edwards | E04B 7/163 49/74.1 |
| 5,941,021 | A * | 8/1999 | Valls, Jr. | E06B 7/086 160/236 |
| 7,335,096 | B2 * | 2/2008 | Perez | E04B 7/163 454/358 |
| 8,413,389 | B2 * | 4/2013 | Frigerio | E04F 10/10 52/75 |
| 8,756,873 | B1 * | 6/2014 | Hire | E04F 10/10 52/72 |
| 9,422,715 | B1 * | 8/2016 | Selzer | E04D 11/00 |
| 9,903,114 | B2 * | 2/2018 | Partridge | E04B 9/003 |
| 10,222,089 | B2 * | 3/2019 | Chappell | F24F 13/1406 |
| 10,767,367 | B2 * | 9/2020 | Krass | E04B 7/166 |
| 10,774,580 | B2 * | 9/2020 | Sosa | E06B 5/11 |
| 2004/0148899 | A1 * | 8/2004 | Pertile | E06B 7/086 52/581 |
| 2013/0291438 | A1 * | 11/2013 | Selzer | E04B 7/163 49/82.1 |
| 2014/0175240 | A1 * | 6/2014 | Selzer | E04F 10/10 248/237 |
| 2016/0115688 | A1 * | 4/2016 | Weaver | E04F 10/10 52/473 |
| 2020/0271392 | A1 * | 8/2020 | Rajani | F28F 9/04 |
| 2020/0370781 | A1 * | 11/2020 | Rockhold | F24F 13/08 |
| 2021/0062505 | A1 * | 3/2021 | Elmore | E04B 7/163 |

* cited by examiner

LOUVERED PANEL ASSEMBLY

FIELD OF THE INVENTION

The present invention is broadly directed to adjustable louvered roof structures and more particularly to a novel improved adjustable louvered roof system with an improved bearing system, the roof system being easier to maintain.

BACKGROUND OF THE INVENTION

Conventional louvered roof assemblies include parallel louvers which are rotated between an open and closed position, as desired. However, many of these systems have a large amount of friction which increases the wear and tear upon the rotatable surfaces but also upon the power equipment as they cause additional drag to the power equipment and require additional power for rotation of the louvers. Therefore, there exists a need to reduce the friction upon the rotatable surfaces.

Some louvered roof assemblies are installed in an outdoor environment where they provide shade and shelter from the underlying area. These roof assemblies also provide shade from the sun. Additionally, these roof assemblies are used at night where lighting is needed to help see in the dark area below the louvers. In addition to task lighting, ambience lighting may be desired to help illuminate the area. However, installing electrical cords and hanging light fixtures around or from the louvers may create an electrical hazard, impact the rotation of the louvers or cause them to fail under the weight of the hanging light fixtures. Therefore, there exists a need to provide an improved illumination system for use with the louvered roof assembly.

Some louvered roof assemblies are installed in an outdoor environment where surrounding trees, bushes and plants may deposit organic debris upon the louvered roof assembly. Some of this debris may become lodged into the rotational surfaces of the louvers which can restrict flow of water or cause water to buildup, increasing the load of the roof assembly and potentially causing the roof to fall or cave-in. Cleaning or removal of any lodged debris may require someone with sufficient expertise and again, based on their availability may still allow a roof to fall or cave-in. In some environments, built-up water may become frozen and expand, causing various mechanical or structural components to break or fail. Therefore, there exists a need to provide for an improved louvered roof assembly system with a way to prevent debris from clogging various components and allowing water to properly drain-off.

Some louvered roof assemblies have louvers which have limited structural support and are unable to satisfactorily span the roof structure. Not every roof assembly is the same size. Some areas are smaller, some are larger. However, louvers with insufficient structural support may not be used in these larger areas or if used, may fail or break. The lack of structural support may also allow the louvers to fail or break over time based upon the ambient condition. Some conditions which can increase the risk of failure include windy, snowy or rainy environments. Therefore, there exists a need to provide improved structural support for the louvers for use with an improved louvered roof assembly which is safer and stronger.

Many louvered roof assemblies allow for adjustment of the louvers between an opened or closed position with a motor operated by a battery or a person. Some include interconnecting or interlocking structure which allows the louvers to rotate between the open and closed position simultaneously. However, many of these louvers are not properly adjusted for full open or full closed positions. In addition, many do not sufficiently close to seal out harsh environmental elements like the snow, rain or wind or prevent the louvers from freezing or slamming shut and potentially damaging the louvers or roof assembly. Therefore, there exists a need to provide for an improved louvered roof assembly with a better sealing structure to protect the assembly from the harsh environmental elements.

Accordingly, there is a need for an improved louvered assembly which reduces friction, strengthen the louver while providing improved lighting, reducing debris and improving drainage, addressing at least a portion of the aforementioned shortcomings.

SUMMARY OF THE INVENTION

The present invention is a mounted roof system with a plurality of louvers which includes interconnecting structure to allow the louvers to open and close in a synchronized manner as desired. The mounted roof system can be mounted to a wall, an eave or may be free standing over an area. The interlocking louvers having an improved interlocking structure and improved structural design can span a larger frame structure, the frame structure further utilizing illumination mounting devices and drainage enabling structures like protective screens which provides water resistance, wind resistance and debris resistance over existing roof systems.

One embodiment of the present invention, an improved louvered panel assembly comprising a louvered panel presenting at least a first louver, a second louver and a control arm, said control arm extending between and connecting each of said first and said second louver for operation of said first and said second louvers between an open and a closed position; each of said first and second louver presenting a central receiver configured for receipt of a first bearing surface configured for rotation said first and second louvers about a rotational axis extending through each of said first and second louver; a leading projection extending from said first louver and configured for downward rotation as said first louver operates between an open and a closed position; a trailing projection extending from said second louver, said trailing projection configured for upward rotation as said second louver operates between an open and a closed position; said trailing projection presenting an upper channel configured for receipt of a sealing membrane; and an engaging structure presented by said leading projection and said trailing projection said engaging structure at least partially sealing said panel assembly with said sealing membrane while said first and said second louvers are in said closed position.

One second embodiment of the present invention, an improved louvered panel assembly comprises a louvered panel presenting at least a first louver and a second louver; a pivot bar extending between each of said first and said second louver; a control arm secured between said pivot bar and an operator for rotating said louvered panel between an open position and a closed position; each of said first and second louver presenting a central receiver configured for receipt of a first bearing surface configured for rotation as said first and second louvers rotated about a rotational axis extending through each of said first and second louver; a leading projection extending from said first louver and configured for downward rotation as said first louver operates between said open position and said closed position; a trailing projection extending from said second louver, said trailing projection configured for upward rotation as said second louver operates between said open position and said closed position; an elongated track extending between said louvered panel said elongated track spaced therefrom by an overlying projection presenting a sealing membrane; said overlying projection received by said track at a rotatable joint configured for rotation of said overlying projection between a winter position and a summer position; and said overlying structure at least partially sealing said panel assembly with said sealing membrane while said overlying projection in said winter position and said louvered panel is in said closed position.

Various objects and advantages of the present invention will become apparent from the following description taken in conjunction with the accompanying drawings wherein, by way of illustration and example, certain embodiments of this invention are set forth. The drawings submitted herewith constitute a part of this specification, include exemplary embodiments of the present invention, and illustrate various objects and features thereof.

DETAILED DESCRIPTION OF THE INVENTION

Detailed embodiments of the present invention are disclosed herein. However, it is to be understood that the disclosed embodiments are merely exemplary of the invention, which may be embodied in various forms. It will be readily understood that the components of the present invention, as generally described and illustrated in the figures herein, may be arranged and designed in a wide variety of different configurations. Thus, the following specific structural and functional details disclosed herein (including the drawings) are not to be interpreted as limiting, but merely representative of the selected embodiments of the invention and as providing a basis for the claims and as providing a representative basis for teaching one skilled in the art to variously employ the present invention in virtually any appropriately detailed structure.

The features, structures or characteristics of the invention described throughout this specification may be combined in any suitable manner in one or more embodiments. For example, the usage of the phrases "example embodiments," "some embodiments," or other similar language, throughout this specification refers to the fact that a particular feature, structure, or characteristic described in connection with the embodiment may be included in at least one embodiment of the present invention. Thus, appearances of the phrases, "example embodiments," "in some embodiments," "in other embodiments," or other similar language, throughout this specification do not necessarily all refer to the same group of embodiments and the described features, structure or characteristics may be combined in any suitable manner in one or more embodiments.

Figure 1:
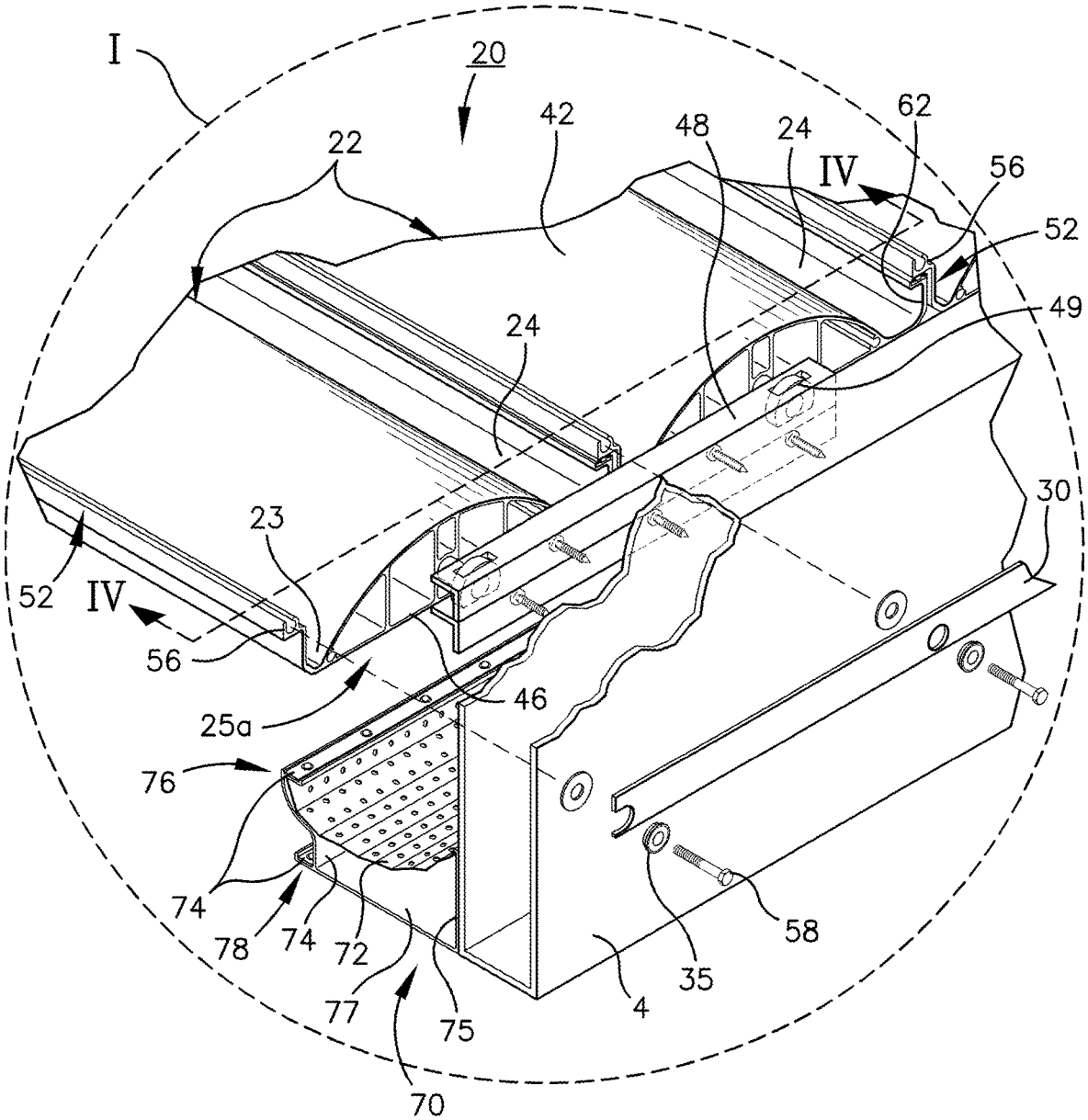
FIG. 1 is an exploded right-side fragmentary perspective view taken from FIG. 3 of an exemplary embodiment of the present invention provided in the closed position with the control arm.
Figure 2:
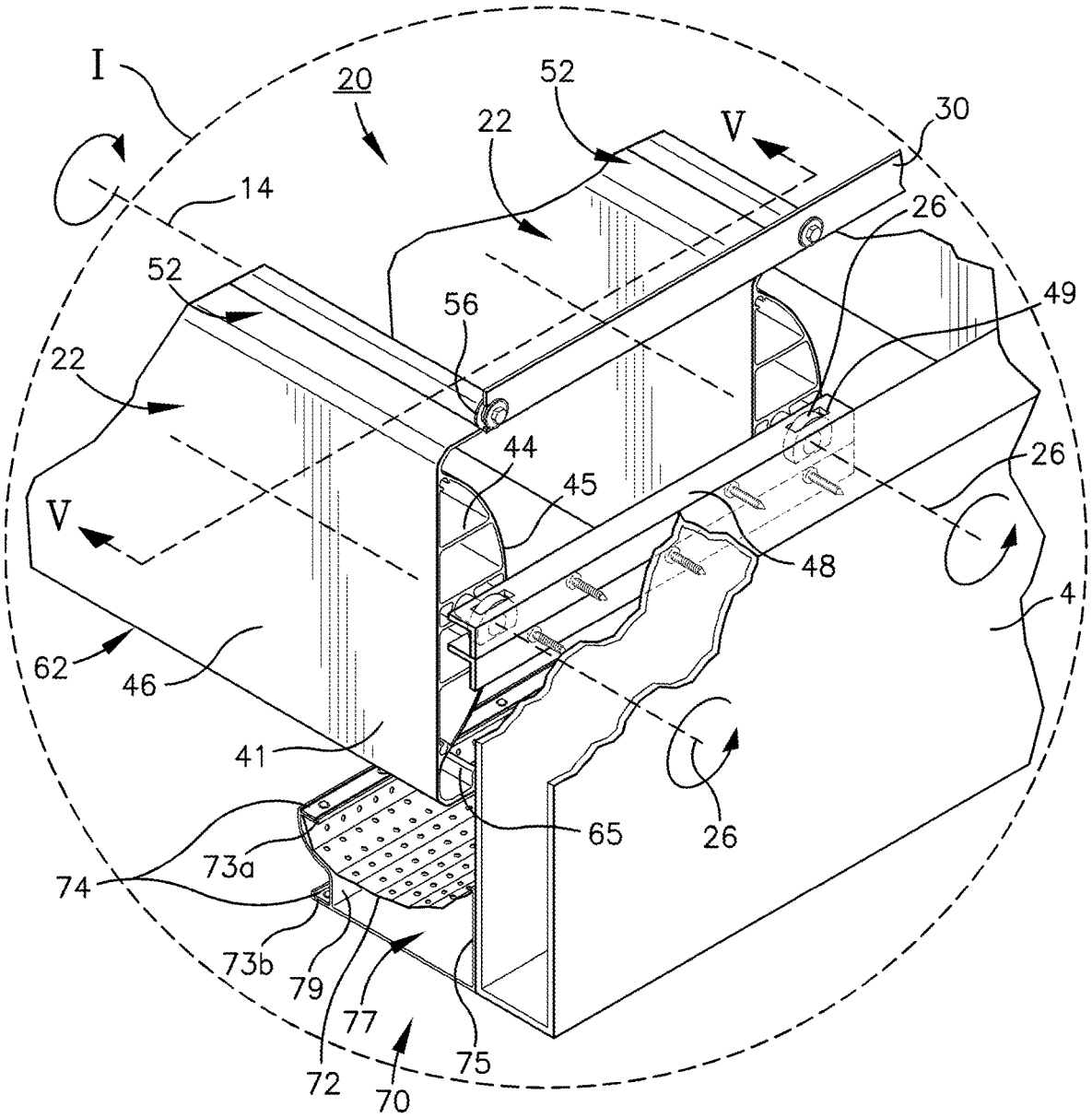
FIG. 2 is an exploded right-side fragmentary perspective view taken from FIG. 3 of an embodiment provided in a partially open position with the control arm operably connected to the louvers.
Figure 3:
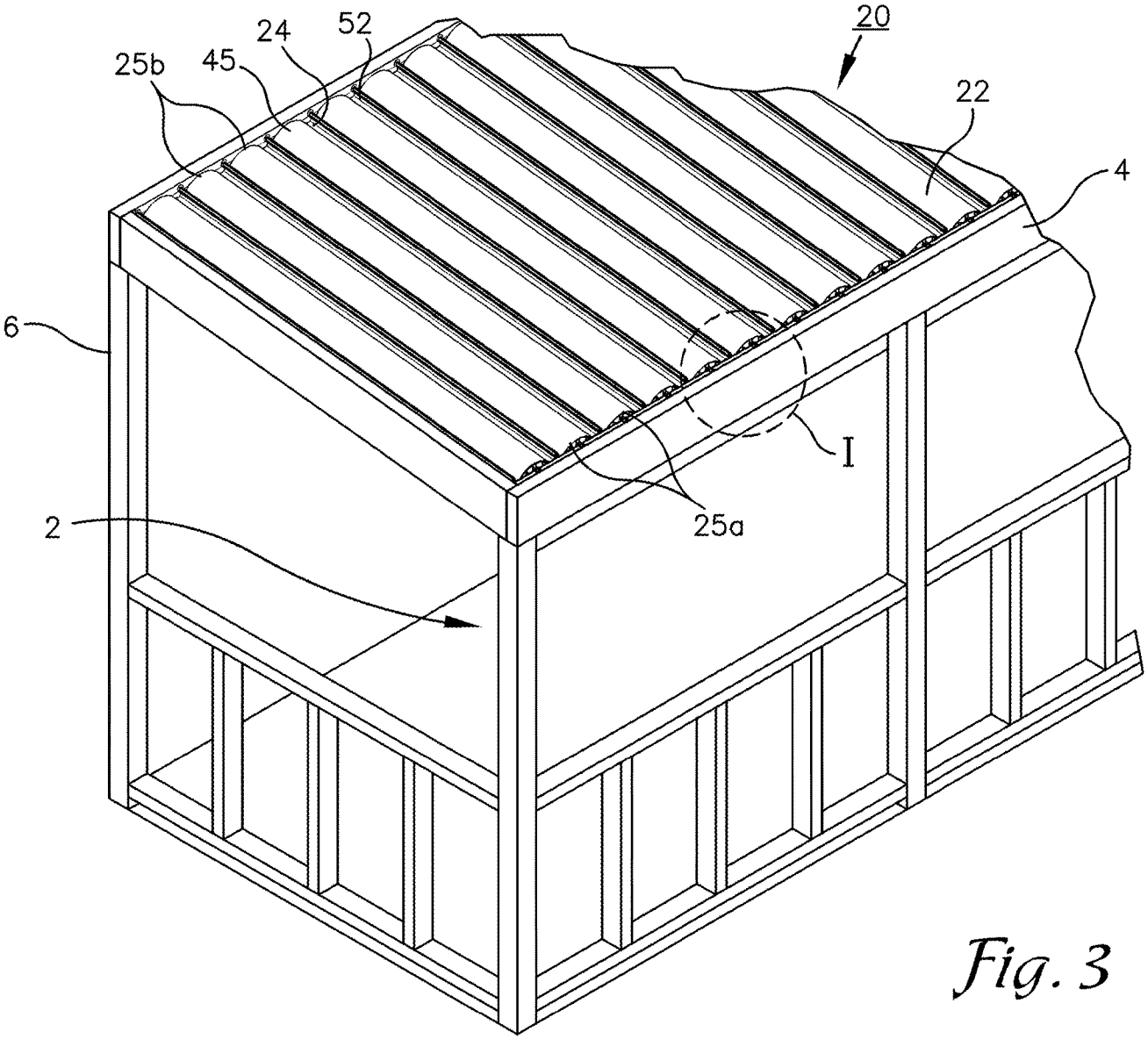
FIG. 3 is a right-side fragmentary perspective view of a roof assembly installed over an outdoor area.

Referring to the drawings in more detail, and specifically FIG. 3, the reference numeral 20 generally refers to an embodiment of the present invention, an improved louver panel assembly adapted for assembly within a four-sided frame 4 which can be installed, for example, over an underlying structure like a patio or deck 2. FIGS. 1-2 illustrate partial perspective views of one embodiment of the improved louvered roof panel 20 having a plurality of louvers 22 adapted for connection as a louvered roof panel 20. FIG. 1 illustrates a partial perspective view of the louvered roof panel assembly 20 provided in a closed position, adapted for protecting an underlying area 2 from rain or sunlight.

Figure 4:
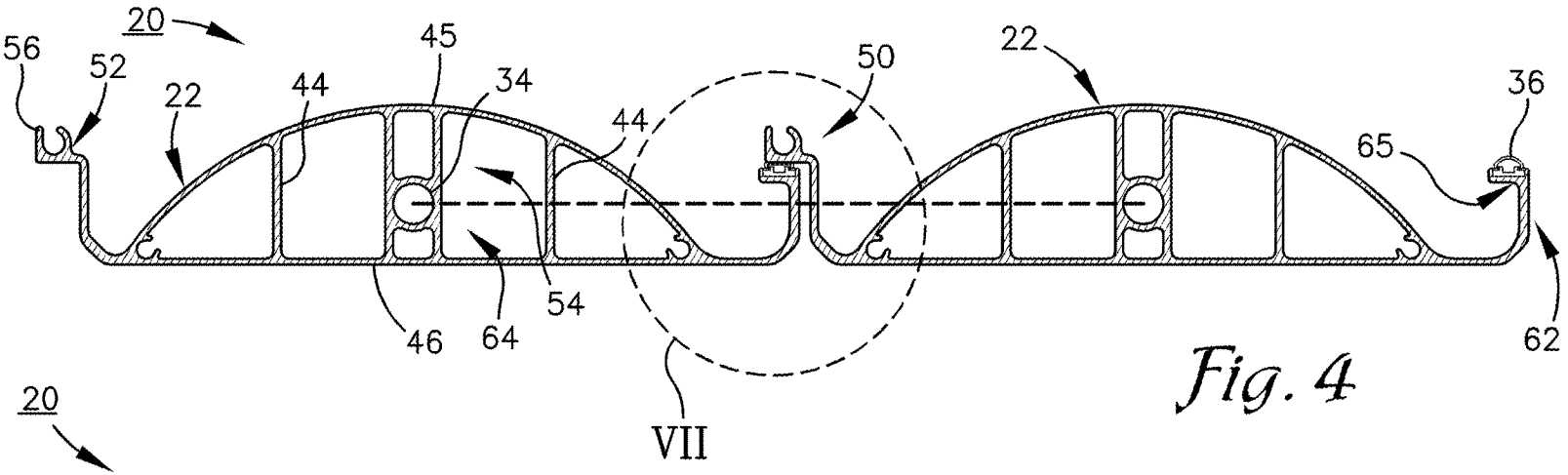
FIG. 4 is a cross-sectional view taken along line IV-IV of FIG. 1 of a pair of louvers provided in the closed position.
Figure 5:
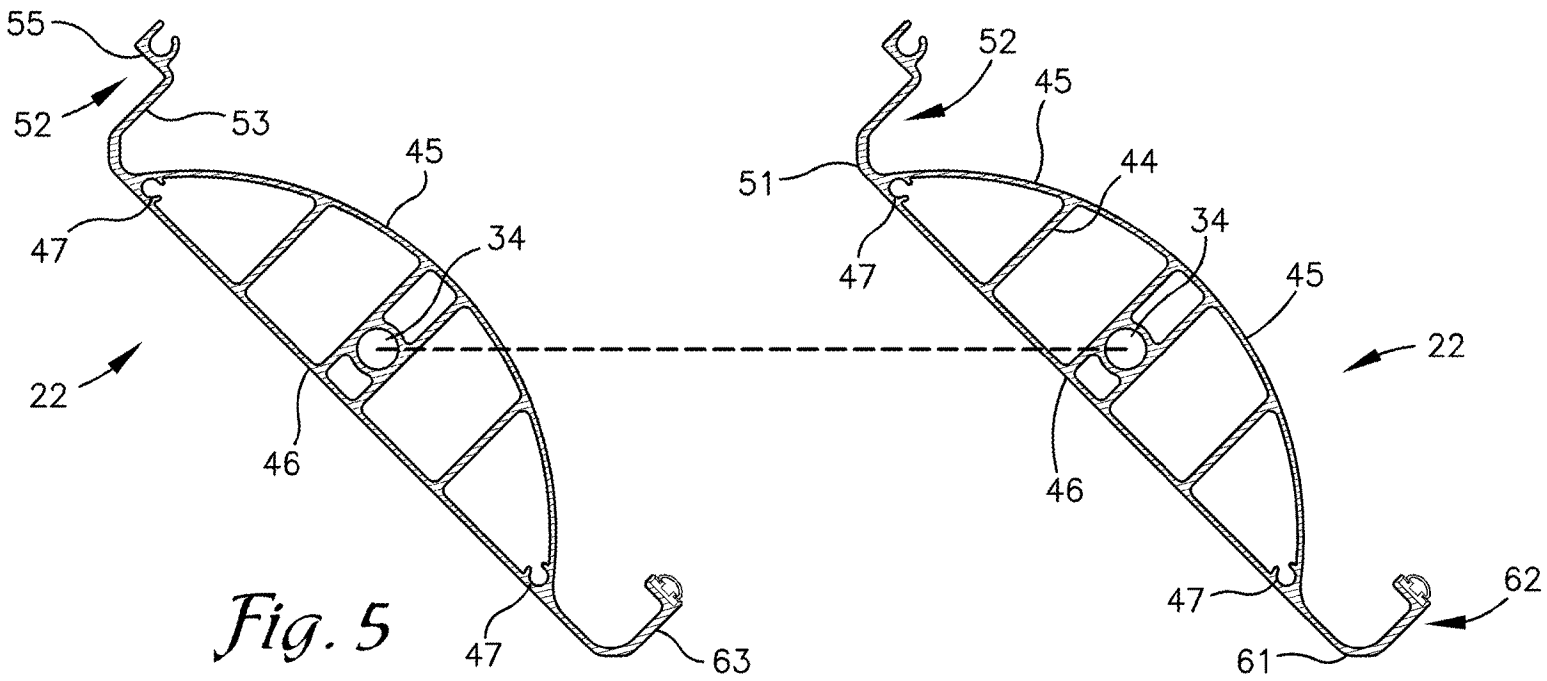
FIG. 5 is a cross-sectional view taken along line V-V of FIG. 2 of a pair of louvers in the partially open position.
Figure 6:
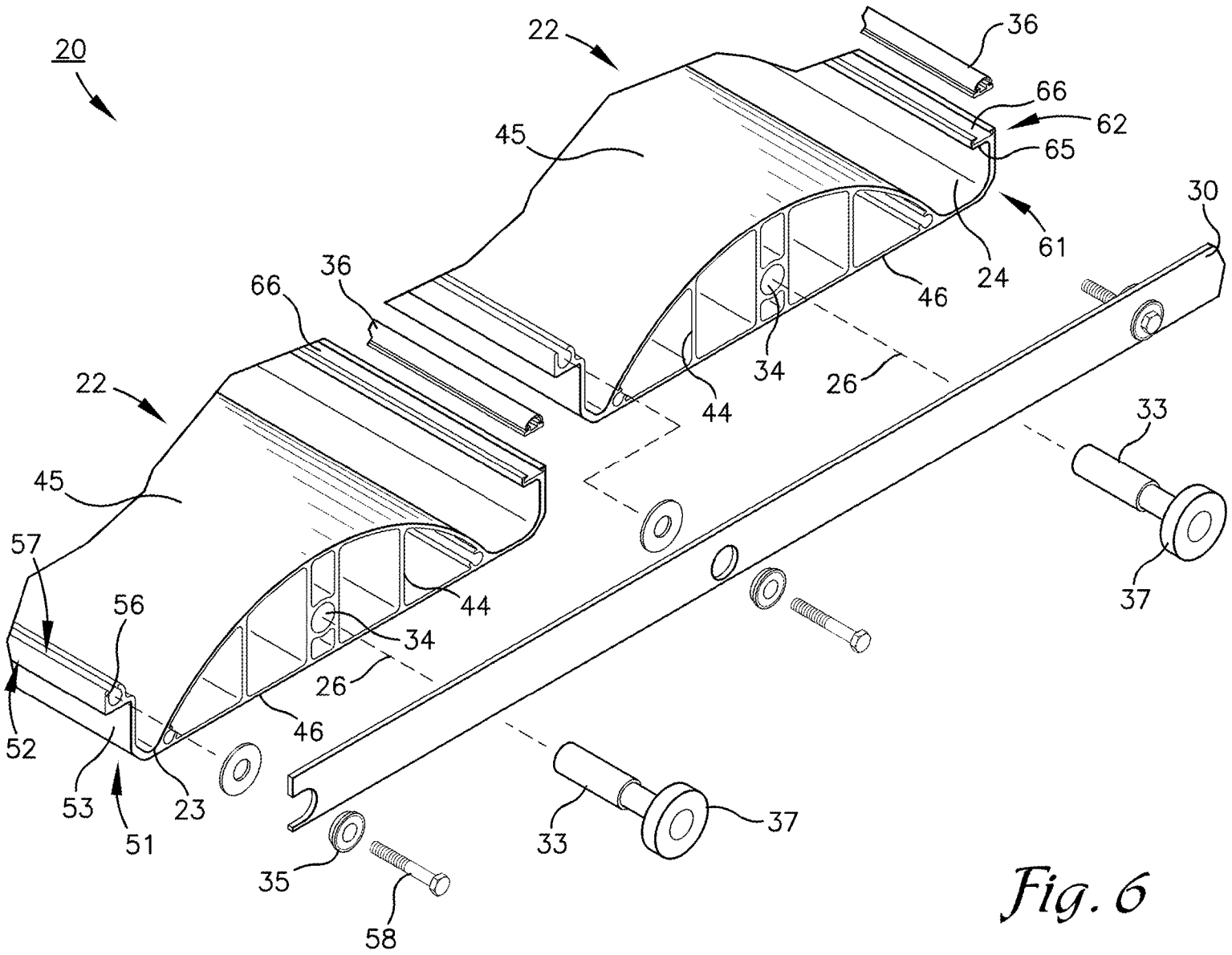
FIG. 6 is an exploded right-side fragmentary perspective view taken from FIG. 3 of the plural louvers provided in a closed position according to one embodiment.

As illustrated in FIGS. 4-6, edges of the louvers 22 are arranged on top of each other via the respective overlying structure 50, also referred to as a drip-edge. The overlying structure 50 generally includes an upper structure 52 also referred to as a leading projection because it is positioned at the front area of the louver 22. The overlying structure 50 also includes a lower structure 62 also referred to as a trailing projection because it is positioned at the rear area of the louver 22. The lower structure 62 is generally positioned below the upper structure 52 and is configured for receipt of a sealing membrane 36 positioned between the upper structure 52 and lower structure 62. The upper structure 52 includes an open parabolic channel 56 adapted for at least partial rotational receipt of a cylindrical fastener 58 for pivoted operation as the louver 22 moves between the open and closed position. When transitioned to the closed orientation or position, the overlying structure 50 at least partially seals the spaces between adjacent louvers 22. FIGS. 4-5 illustrate the pair of louvers 22 as they rotate from the closed position (FIG. 4) towards a partially open position (FIG. 5). FIG. 6 presents an exploded view of the pair of louvers 22 with the overlying structure 50.

The improved louvered panel assembly 20 includes a plurality of louvers 22 in rotatable communication, mounted within the frame 4. Each louver 22 includes the substantially planar surface 46 and a convex surface 45 joined together at leading edge 51 and a trailing edge 61. In the illustrated embodiment, both the leading and trailing edge 51, 61 have a curved shape. In general, the leading edge 51 and trailing edge 61 present a pair of channels. The first channel 23 is associated with the leading edge 51 and a second channel 24 is associated with the trailing edge 61. A plurality of interiorly spaced uprights 44 extend between the lower planar surface 46 and upper convex surface 45, each spaced upright 44 presenting a longitudinally extending plane. The rotational axis 26 extends longitudinally and centrally through an aperture in the receiver 34 of the louver 22 that receives a first bearing surface 37 and a second bearing surface (not shown).

In the illustrated embodiment, the first bearing surface 37 and second bearing surface (not shown) are functionally equivalent with both having an outer rolling surface operably connected at a central region to a cylindrical projection configured for receipt within a central receiver 34 associated with each louver 22

In operation, each louver 22 rotates about a rotational axis 26 extending longitudinally through the central receiver 34 from a first end 25*a* to a second end 25*b*. The open parabolic channel 56 presents an arcuate opening 57 which presents the pivot for pivoted operation of the louver 22 as it moves from the closed to open positions. A pivot axis generally extends along the open parabolic channel 56 during rotation of the louver 22 about the rotational axis 26 through the arcuate opening 57. In the depicted embodiments of FIGS. 1-2, the pivot axis extends centrally through the open parabolic channel 56 originating at the arcuate opening 57 associated with the first end 25*a*.

As depicted in FIGS. 3 and 6, during operation, the louvers 22 are assembled with multiple louvers 22 interconnected with control arm 30 in operable communication with each louver 22. Transition of each louver 22 between the open and closed positions, is generally performed together as the control arm 30 moves each louver 22 while they rotate together about each rotational axis 26 extending through the pivot axis associated with the open parabolic channel 56 associated with each louver 22. Generally, the control arm 30 operates the louvers 22 together in a general pivoted movement about the rotational axis 26.

According to the embodiment of the louvered panel assembly 20 illustrated in FIG. 1, the louvers 22 are generally arranged into a louver assembly 20 or panel for installation within a four-sided frame 4, although the frame 4 may take on any general architectural shape consistent with the purposes herein. The louvers 22 installed within the frame 4 are generally parallel and aligned with each other. The control arm 30 generally operates the louvers 22 for rotational operation of the louver 22 through the arcuate opening 57 associated with at least one of the leading or trailing projections 52, 62. The control arm 30 generally operably connects the louvers 22 to each other.

A roller 37 is operably connected to the cylindrical bearing 35 for maintaining the position of the louver 22 during rotation from the open to the closed position. The roller 37 is generally received within the track 48, the roller 37 extending outwardly through the track 48 at one of the plural slots 49. Generally, each slot 49 corresponds to each louver 22, the slots 49 being spaced apart a distance corresponding to the width of each louver 22 and generally aligned along the rotational axis 26 extending centrally from the roller 37 through the central receiver 34. Generally, the slots 49 are spaced along the track 48 as desired for longitudinal spacing of the louvers and have a dimension less the diameter of the roller 37 to help contain the roller 37 within the track 48. The slots 49 allow for controlled rotation of the roller 37 within the slot 49 thereby maintaining the roller 37 in alignment at the desired position along the track 48.

The cylindrical bearing 35 centrally receives a spacer 33 associated with the roller 37 and extending from the roller 37 for receipt by the cylindrical bearing 35. Generally, a spacer 33 allows for proper lateral positioning of the louver within the installed frame for alignment during operation of the panel assembly 20 while maintaining each louver 22 in rotational alignment with the rotational axis 26. Generally, the tracks 48 are secured to the frame 4 in pairs and are secured in a direction normal to the louvers 22 at the first and second ends 25*a*, 25*b*. In the illustrated embodiment of the panel assembly 20, one or both tracks 48 are associated with opposite frame 4 members, each track 48 receiving a plurality of the rollers 37.

As illustrated in the embodiment of the panel assembly 20 of FIG. 1, the projection or spacer 33 associated with one of the rollers 37 may extend from the track 48 through one of the louver 22 first and second ends 25*a*, 25*b*. Generally, each track 48 is secured to opposite sides of the frame 4. In the illustrated embodiment, a pair of tracks 48 may be securely positioned along opposite sides of the frame 4 for receipt of each side of the louver 22, the first end 25*a* and second end 25*b*. In the closed position, the plural louvers 22 present a generally horizontal surface which is illustrated for example as a rectified sinusoidal wave.

As further illustrated in FIG. 2, the louvers 22 pivot the leading projection 52 about the rotational axis 26 which extends from the first bearing surface 37 through the second bearing surface (not shown). During upward pivoted rotation of the leading projection 52, a trailing projection 62 is rotated down towards a gutter 70. In the closed position, depicted in FIG. 1, the substantially planar surface 46 is positioned in a generally horizontal orientation above the gutter 70. In the open position depicted in FIG. 2, the trailing projection 62 is rotated downward with the substantially planar surface 46 extending vertical.

The illustrated embodiment of the gutter 70 is generally mounted to the frame 4 and includes a perforated cover 72 extending along the frame 4 presenting a carrier for transporting any captured moisture or debris away from the underlying structure 2. In the embodiment depicted in FIGS. 1-2, the gutter 70 is in alignment with the track 48 and perpendicular to the louvers 22. The embodiment of the gutter 70 illustrated in FIG. 1 includes a first ledge 76 and a second ledge 78 adapted for receipt of an illumination strip 74 for illuminating the underlying structure 2.

The fragmented view of the louvered panel assembly 20, illustrated in FIGS. 2-3, is rotated into the open position in FIG. 2, allowing for drainage of any excess water falling between the louvers 22 into the gutter 70. Generally, the gutter 70 is secured to the frame 4. As the louvers 22 are rotated into the open position, water extends along the first and second channel 23, 24 from the louver 22 for drainage into the gutter 70.

Inclined installation of the louver panel assembly 20 may allow movement or drainage of water from the panel 20 through the gutter 70 structure; however, the frame 4 may be installed in a generally horizontal or flat orientation. Additional framing or cross-sectional members 6 may be used to support the frame 4 and to mount any desired illumination strips 74 and proper drainage as further depicted herein.

The illustrated gutter structure 70 of FIGS. 1-2, generally includes a supporting sidewall 75 separated from an outer sidewall 79 by a collector 77 for collecting water and transporting it away from the frame 4. The supporting sidewall 75 is generally secured to the frame 4. The collector 77 spans the supporting sidewall 75 and the outer sidewall 79. The illustrated outer sidewall 79 generally presents a first ledge 76 and a second ledge 78 for attaching and extending the illumination strips 74 along the interior space of the frame 4 so that the interior underlying surface 2 can be illuminated, for example, at night. The first ledge 76 extends inwardly from an upward lip 73*a* associated with the outer sidewall 79 of the gutter 70, while the second ledge 78 extends outwardly from downward lip 73*b* associated with the outer sidewall 79 of the gutter 70.

The illustrated embodiment of the illumination strip 74 may be an incandescent filament style or LED style, particularly an LED array arranged in a strip 74. However, other types of illumination may be utilized including ropes, strips and tapes, some may have the same color, some may include a variety of colors, some may be low power, other may be higher power, some may be dimmable, some may be wireless, some may be battery powered. In one embodiment, the illumination is provided by a water-proof LED strip, based on the standards of IP65 or IP67 and of a particular color, like blue. Alternatively, the track 48 with various elongated channels may also be used to secure additional illumination strips 74 along a lower portion of the track 48.

A control arm 30 is used for moving a plurality of louvers 22, also referred to as a louver assembly 20 or panel, between the open and closed positions. One embodiment of the control arm 30, illustrated in FIG. 2 extending between adjacent louvers 22, is rectangular and mechanically joins to one end of each louver 22 within the louver assembly 20. As illustrated, the control arm 30 is operably connected along the open parabolic channel 56 between adjacent louvers 22 for pivoted operation of the louvers 22. As optionally illustrated in FIG. 9, an operator 80 may be an actuator or motor which is pneumatic, electric, hydraulic or hand powered with connected linking members 82 such as, but not limited to, a linear drive (not shown) or some other type of driven structure, to transmit a force to an alternative control arm 130 based on open and close position commands for selectively moving each louver 22 within a louver assembly 20 from the closed to the open position. Additional drive elements 84 may be utilized in transmitting a force associated with the open and close positions commands to the control arm 130.

An illustration of plural louvers 22 assembled as the louver assembly 20, also referred to herein as a panel, is illustrated in FIG. 3. The louver assembly 20 may be installed to span the illustrated four-sided frame 4, for example, over an outdoor area like a deck or patio 2. Depending on the underlying area dimensions, the frame 4 may include additional vertical support structures for receipt and support of the louvers 22.

Figure 9:
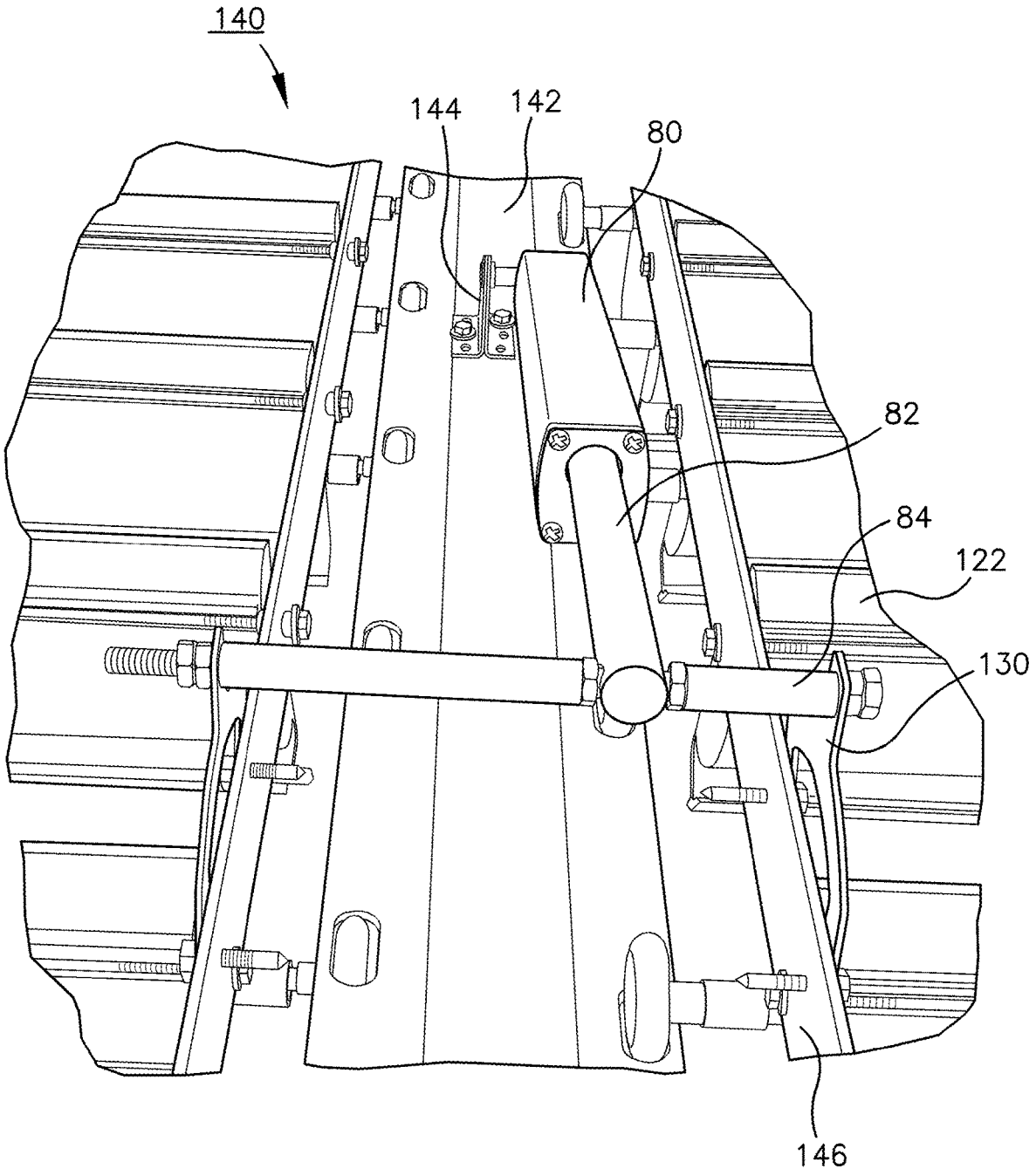
FIG. 9 is a perspective view of an alternative louver panel assembly with an operator connected between a pair of louver assemblies.

An alternative louver assembly 140 is illustrated in FIG. 9 with a central support 142 extending between two sections of the louver assembly 140 with the operator 80 secured thereto. FIG. 9 also illustrates a mounting structure for mounting the operator 80 to central support 142, including a pair of upright brackets 144 which are mounted between the central support 142 and one end of the operator 80, opposite the linking member 82. In the illustrated embodiment of FIG. 9, the operator 80 is configured for driving both sections of the louver assembly 140 simultaneous using an alternative control arm 130. Alternatively, one operator 80 may be utilized for separately driving both sections of the louver assembly 140, or multiple operators 80 may be utilized for operating each section of the louver assembly 140 using various preconfigured operational characteristics, such as rotating the louvers to the open position sequentially, consecutively, or logically based upon various environmental or emergency conditions such as based upon a weather condition, temperature or upon the presence of a fire.

The alternative louver assembly 140 presents a roof structure with a seal provided between adjacent alternative louvers 122 which presents a partially sealed barrier to ambient conditions for use as the top of an enclosure or a three (3) season room. The louvers 22 and alternative louvers 122 present a substantially planar bottom surface when in the closed position.

Figure 8:
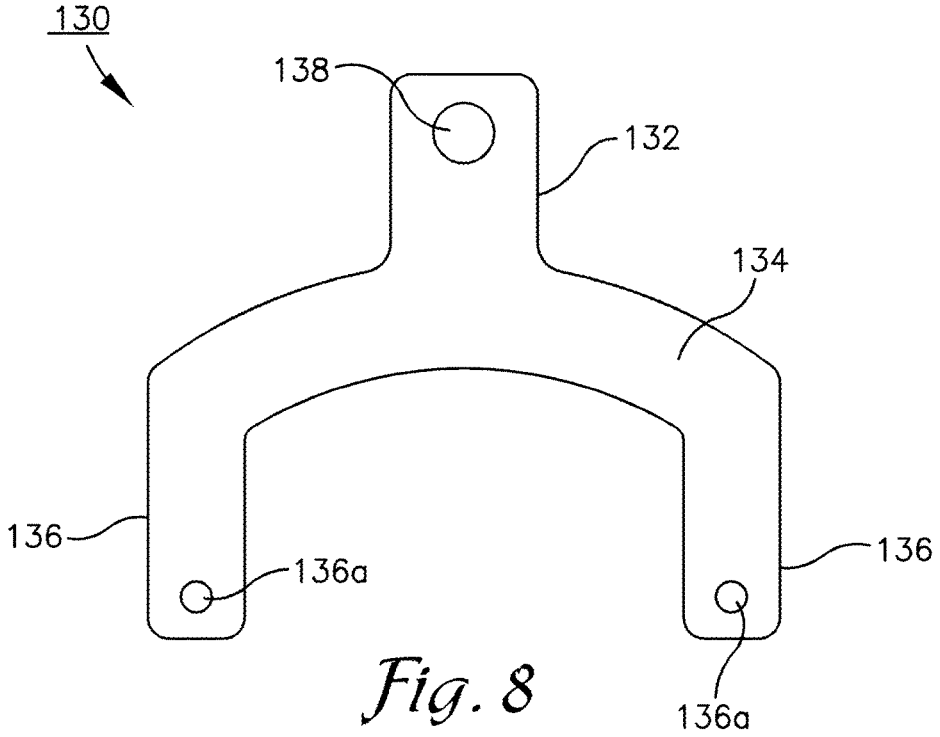
FIG. 8 is a side view of an exemplary embodiment of an alternative control arm illustrated in FIG. 9.

The alternative control arm 130 illustrated in FIG. 8 has a generally "horseshoe" shape. The depicted alternative control arm 130 includes a pair of downward depending supports 136 extending from a shoulder 134 which is operably connected to the collar 132. Each downward depending support 136 includes a central aperture 136*a* for fastening the alternative control arm 130 to the louver 22. In addition, the illustrated alternative collar 132 is adapted for operation by the operator 80 with a receiver 138. Although the control arm 30 is illustrated as rectangular and the alternative control arm 130 is illustrated with an arcuate "Y" configuration, various shapes and sizes may be utilized for operably connecting the operator 80 to the louver assembly 20, 140. As further depicted in FIG. 9, the alternative control arm 130 is secured to a pivot bar 146. Generally, the pivot bar 146 is in operable communication with each alternative louver 122, each pivot bar 146 extending along each louver panel 140 and presenting the alternative control arm 130. The depicted pivot bar 146 allows the alternative louvers 122 in both sections of the louver panel 140 to rotate together in synchronization through the angle of rotation which is generally between 0 and 180 deg.

As further illustrated in FIGS. 4-5, each louver 22 has an outer surface which is elliptical or parabolic as it extends from a generally symmetrical curved leading edge 51 to a generally curved trailing edge 61. The illustrated embodiment of the louver 22 has the leading and trailing edge 51, 61, extending from the leading to trailing projection 52, 62. In addition, at the junction of the convex upper surface 45 and substantially planar lower surface 46, a pair of angled arcuate channels 47 are presented which offer greater strength while transmitting any debris from the interior of the louver 22 to the gutter 70 while also allowing receipt of a rotational mechanical fastener (not shown).

A chord is presented by the louver 22 which corresponds to the distance from the curved leading edge 51 to the curved trailing edge 61. The chord is generally configured to conform to the desired aerodynamic effect of the ambient air extending along the louver surface 22. In one embodiment, the curved trailing edge 61 is designed to maintain a desired chord distribution to minimize elliptic loading. Generally, the chord describes the curvature effect of the louver 22 from the leading edge 51 to the trailing edge 61. The louver 22 has a convex upper surface 45 and a substantially planer lower surface 46, a plurality of supporting members illustrated as vertical uprights 44 extending between the upper surface 45 and lower surface 46. In the depicted embodiment, the vertical uprights 44 are generally spaced equally throughout the louver, generally located at the 25 and 75 percent chord positions and presenting a plane of support.

A central receiver 34 is generally located near the middle chord position and includes an upper section 54 and a lower section 64. The upper section 54 generally corresponds to the convex area above the chord and the rotational axis 26 and the lower section 64 generally corresponds to the more planar area below the chord and the rotational axis 26. The upper and lower sections 54, 64 come together at the central receiver 34.

The central receiver 34 is generally adapted for receipt of a cylindrical bearing 35 and upon receipt, the friction between the central receiver 34 and the spacer 33 rotates with less friction during rotation of the louver 22. Generally, the cylindrical bearing 35 assists in reducing rotational friction as the louver 22 rotates from the open to the closed position.

An embodiment of the overlying structure 50 is depicted in FIGS. 4-6 and generally includes the leading and trailing projections 52, 62. The leading projection 52 is generally adapted for reciprocal operation as the control arm 30 is selectively operated to move the louvered panel assembly 20 between the closed and open position. The depicted embodiment of the leading projection 52 illustrates a substantially vertical projection 53 with a planar extension 55 which presents the open parabolic channel 56 with a generally arcuate aperture for operable connection to the control arm 30.

The depicted embodiment of the trailing projection 62 illustrates a substantially vertical projection 63 with a forwardly extending trailing arm 65 which presents an upper channel 66. The upper channel 66 is adapted for removable receipt of the resilient member 36 presenting a weather resistant seal. Generally, the leading projection 52 and trailing projection 62 are adapted for interconnection in an overlying orientation with the leading projection 52 overlying the trailing projection 62 and with the assistance of a resilient membrane 36 received within the upper channel 66, presenting a weather resistant barrier while the louvers 22 are in the closed position. In the depicted embodiment, the resilient membrane 36 may be selectively removed from the upper channel 66 as desired.

As further illustrated in FIGS. 4-5, during transition between the open and closed positions, the louvers 22 rotate about the central receiver 34 and remain in alignment throughout the transition between the closed and open positions.

In one embodiment while the louvered roof assembly 20 is in the closed position a visually appealing surface is provided from the underlying area 2 from which the closed louvers 22 may depict a tongue and groove surface, which along with the gutter 70, may be fashioned to appear like various types of trim molding, like crown, thereby enhancing the visual appeal and aesthetics of the area 2 surrounded by the improved louvered roof assembly 20.

FIG. 6 illustrates an exploded view with the control arm 30 being adapted for receipt by the leading projection 52 and the cylindrical bearings 35 received within the central receivers 34 associated with each louver 22. As the control arm 30 moves reciprocally, the leading projection 52 rotates, causing the louver 22 to rotate about the cylindrical bearing 35. In addition, the resilient membrane 36 adapted for receipt by the upper channel 66 is illustrated above the upper channel 66. Once installed, the resilient membrane 36 will help seal the leading projection 52 in overlying relation to the trailing projection 62 while the louvered panel assembly 20 is in the closed position.

Figure 7:
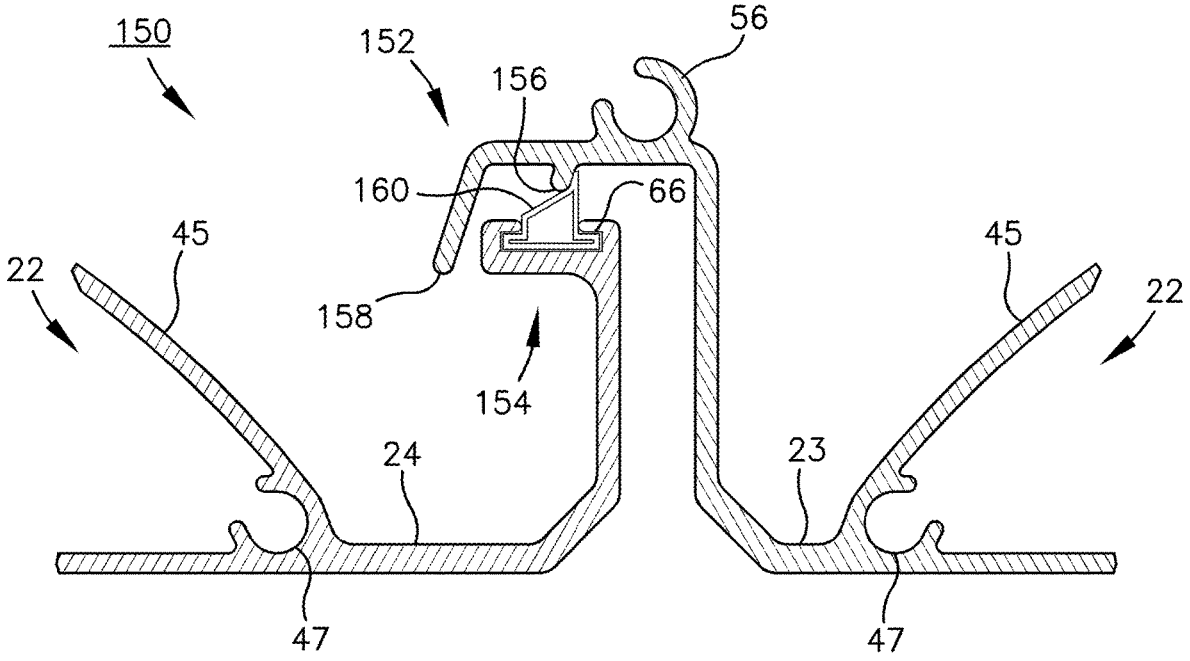
FIG. 7 is a fragmentary, exploded sectional view of a pair of louvers taken from FIG. 4 in a closed position with the addition of an alternative drip edge.

FIG. 7 illustrates an embodiment of an alternative overlying structure 150 with an alternative upper structure 152 separated from an alternative lower structure 154 by an alternative sealing membrane 160. The alternative upper structure 152 presents the open parabolic channel 56 along with a first depending lip 156 spaced from a second depending lip 158. The open parabolic channel 56 is generally upwardly presented, while the first and second depending lips 156, 158 are angled downwardly. The alternative sealing membrane 160 is generally positioned between the first and second depending lips 156, 158. As illustrated, the alternative overlying structure 150 generally presents an improved "double-sealed" structure, which at least partially seals the area between the adjacent louvers 22. Moisture and debris are directed from the alternative overlying structure 150 into one of the first or second channel 23, 24 allowing for transmission of any contained material away from the frame 4 and underlying structure 2 towards the gutter 70. The alternative sealing membrane 160 is received within the upper channel 66 and has a generally angled upper surface for possible engagement by one or both of the first and second depending lips 156, 158. The sealing membrane 36 and alternative sealing membrane 160 are generally made from a resilient weather resistant type of material.

Figure 10:
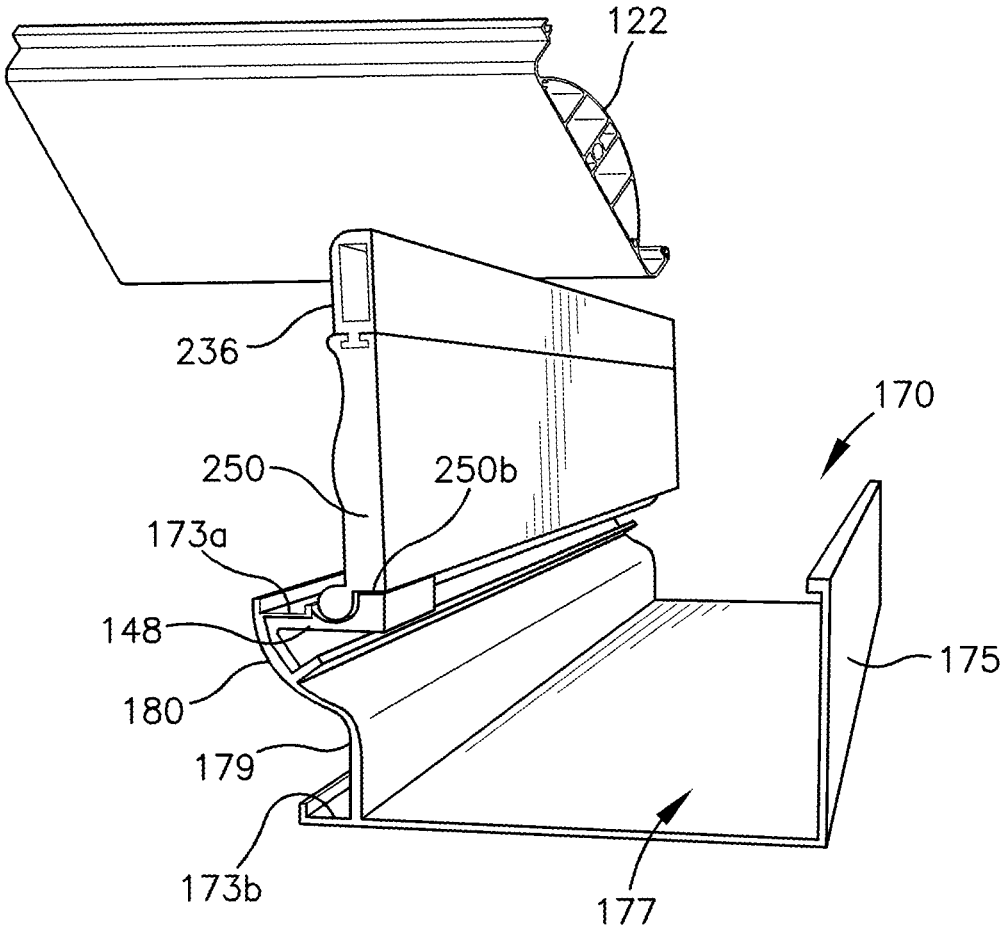
FIG. 10 is a front perspective view of an alternative gutter with an alternative track presenting a rotational receiver for receiving flap structure provided in the closed or winter position.
Figure 11:
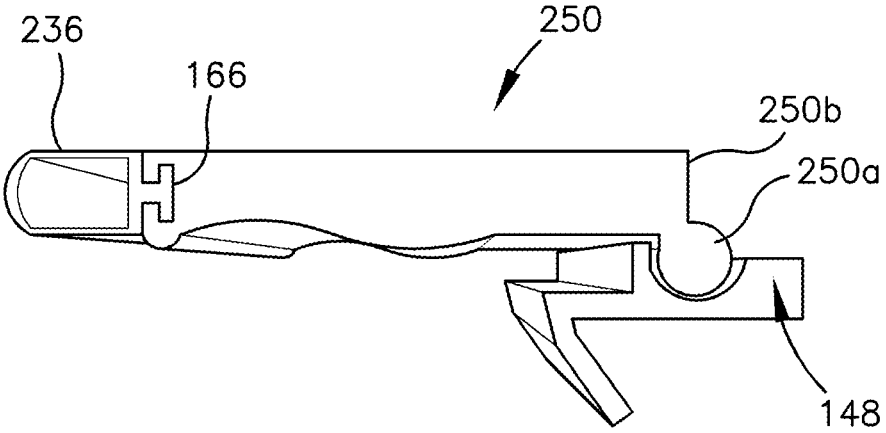
FIG. 11 is a front perspective view of the alternative overlying structure illustrated in FIG. 10 provided in the open or summer position.

FIGS. 10-11 illustrate an alternative louver 122 with an alternative gutter 170 adapted for receipt of an alternative or elongated track 148 having a rotational receiver for receiving an flap structure 250 having an upper channel 166 adapted for receipt of a second alternative membrane 236. The alternative gutter 170 includes an alternative supporting sidewall 175 separated from an alternative outer sidewall 179 and including a generally triangular channel 180 for receipt of the alternative track 148.

FIG. 11 illustrates the flap structure 250 in an open or "summer" position. In a sealed or "winter" position, illustrated in FIG. 10, the flap structure 250 is rotated to an upright position using a rotatable joint. In the "winter" position, shoulder 250*b* is positioned adjacent to, or near, the alternative track 148, providing support to the flap structure 250 while in the "winter" position. In the "winter" position, the alternative membrane 236 also extends upward.

Generally, the flap structure 250 will rotate up when the louvers 22, 122 are closed and will rotate down when the louvers 22, 122 are open, providing protection against bugs in the summer months and to at least partially seal when the weather is cold. The rotatable joint is generally comprised of a socket 148*a* and a ball 250*a*. In operation, the flap structure 250 is positioned in the winter position by turning off power to the operator 80 and rotating the alternative louvers 122 closed and then rotating the flap structure 250 with the alternative membrane 236 under the alternative louvers 122.

The alternative track 148 generally includes an upper section presenting the socket 148*a* and a depending leg 148*b* having a confirming shape for receipt by the triangular channel 180. The depending leg 148*b* is generally configured for supporting the flap structure 250 as it rotates between an upper, generally vertical position and a lower, generally horizontal position. The flap structure 250 generally presents an arcuate surface on one side and a planar surface on the opposite side joined by an alternative upper channel 166 and a rotatable support 250*a* extending rearwardly for receipt by the socket 148*a* during rotation of the flap structure 250. The alternative upper channel 166 is generally adapted for receipt of the second alternative membrane 236. In general, the sealing membrane 36, alternative sealing membrane 160 and second alternative membrane 236 at least partially seal the louvers 22, 122 to selectively limit ambient conditions (like wind or rain), debris (like leaves, limbs or pollen) or animals (like bugs) from the underlying area.

It is to be understood that while certain forms of the present invention have been illustrated and described herein, it is not to be limited to the specific forms or arrangement of the parts described and shown.

What is claimed and desired to be secured by Letters Patent:

1. An improved louvered panel assembly comprising:

a louver panel having at least a first louver and a second louver;

a pivot bar extending between each of said first and said second louvers;

a control arm secured between said pivot bar and an operator to rotate said louver panel between an open position and a closed position; and each of said first and second louvers having a central receiver that receives a first bearing surface configured for rotation of said first and second louvers about a rotational axis extending through each of said first and second louvers;

a leading projection extending from said first louver and configured for downward rotation as said first louver operates between said open position and said closed position;

a trailing projection extending from said second louver, said trailing projection configured for upward rotation as said second louver operates between said open position and said closed position;

an elongated track positioned below said louver panel;

said elongated track spaced from said louver panel by a flap structure having a sealing membrane;

said flap structure received by said elongated track at a rotatable joint configured for rotation of said flap structure between a sealed position and an open position; and said flap structure at least partially sealing said panel assembly with said sealing membrane when said flap structure is provided in said-sealed position and said louver panel is provided in said closed position.

2. The improved louvered panel assembly of claim 1, wherein the first and second louvers include leading and trailing edges and a convex-shaped upper surface that forms corresponding channels with the leading and trailing edges, the upper surface being mechanically coupled to a substantially planar lower surface through a plurality of spaced uprights.

3. The improved louver panel assembly of claim 2, wherein the substantially planar lower surface forms a tongue and groove pattern with adjacent louvers.

4. The improved louver panel assembly of claim 1, further comprising a first track that is oriented substantially perpendicular to first ends of the first and second louvers, the first track being coupled to the first and second louvers through the first bearing surface.

5. The improved louver panel assembly of claim 4, further comprising a second track that is oriented substantially perpendicular to second ends of the first and second louvers, the second ends being opposite to the first ends, the second track being coupled to the first and second louvers through a second bearing surface.

6. The improved louver panel assembly of claim 1, wherein the leading edge includes an open parabolic channel configured to receive a fastener.

7. A horizontally-oriented louvered panel assembly that forms a roof structure, the louvered panel assembly comprising:

a first louver having leading and trailing edges that extend upward to form corresponding channels at an upper surface, the trailing edge having a trailing arm that supports a resilient membrane;

a second louver having leading and trailing edges that extend upward to form corresponding channels at an upper surface, the trailing edge having a trailing arm that supports a resilient membrane, the first and second louvers having a central receiver adapted to receive a first bearing surface that enables rotation about a rotational axis extending therethrough;

a control arm that mechanically couples the first and second louvers;

an overlying structure formed by the leading projection of the second louver and the trailing projection of the first louver having the corresponding resilient member, the overlying structure at least partially seals the louvered panel assembly from external elements when provided in a closed position; and a flap structure having a rotational receiver that rotates the flap structure between an open or horizontal position and a closed or vertical position.

8. The louvered panel assembly of claim 7, wherein the first and second louvers include a convex-shaped upper surface that forms the corresponding channels with the leading and trailing edges, the upper surface being mechanically coupled to a substantially planar lower surface through a plurality of spaced uprights.

9. The louver panel assembly of claim 8, wherein the substantially planar lower surface forms a tongue and groove pattern with adjacent louvers.

10. The louver panel assembly of claim 7, further comprising a first track that is oriented substantially perpendicular to first ends of the first and second louvers, the first track being coupled to the first and second louvers through the first bearing surface.

11. The louver panel assembly of claim 10, further comprising a second track that is oriented substantially perpendicular to second ends of the first and second louvers, the second ends being opposite to the first ends, the second track being coupled to the first and second louvers through a second bearing surface.

12. The louver panel assembly of claim 7, wherein the leading edge includes an open parabolic channel configured to receive a fastener.

13. A horizontally-oriented louvered panel assembly that forms a roof structure, the louvered panel assembly comprising:

a first louver having leading and trailing edges that extend upward to form corresponding channels at an upper surface, the trailing edge having a trailing arm that supports a resilient membrane;

a second louver having leading and trailing edges that extend upward to form corresponding channels at an upper surface, the trailing edge having a trailing arm that supports a resilient membrane, the first and second louvers having a central receiver adapted to receive a first bearing surface that enables rotation about a rotational axis extending therethrough;

a control arm that mechanically couples the first and second louvers;

an overlying structure formed by the leading projection of the second louver and the trailing projection of the first louver having the corresponding resilient member, the overlying structure at least partially seals the louvered panel assembly from external elements when provided in a closed position;

a flap structure having a rotational receiver that rotates the flap structure between an open or horizontal position and a closed or vertical position; and a gutter positioned below the louvered panel assembly.

14. The louvered panel assembly of claim 13, wherein the first and second louvers include a convex-shaped upper surface that forms corresponding channels with the leading and trailing edges, the upper surface being mechanically coupled to a substantially planar lower surface through a plurality of spaced uprights.

15. The louver panel assembly of claim 14, wherein the substantially planar lower surface forms a tongue and groove pattern with adjacent louvers.

16. The louver panel assembly of claim 13, further comprising a first track that is oriented substantially perpendicular to first ends of the first and second louvers, the first track being coupled to the first and second louvers through the first bearing surface.

17. The louver panel assembly of claim 16, further comprising a second track that is oriented substantially perpendicular to second ends of the first and second louvers, the second ends being opposite to the first ends, the second track being coupled to the first and second louvers through a second bearing surface.

18. The louver panel assembly of claim 13, wherein the leading edge includes an open parabolic channel configured to receive a fastener.

* * * * *